US010579088B1

(12) United States Patent
Toscano

(10) Patent No.: US 10,579,088 B1
(45) Date of Patent: Mar. 3, 2020

(54) DEVICE CONVERTIBLE FOR OPERATING BRAKE AND ACCELERATION PEDALS OF A VEHICLE BY HANDS AND LEGS

(71) Applicant: Alfredo Toscano, Wildomar, CA (US)

(72) Inventor: Alfredo Toscano, Wildomar, CA (US)

( * ) Notice: Subject to any disclaimer, the term of this patent is extended or adjusted under 35 U.S.C. 154(b) by 0 days.

(21) Appl. No.: 16/250,007

(22) Filed: Jan. 17, 2019

(51) Int. Cl.
*G05G 1/48* (2008.04)
*G05G 1/487* (2008.04)

(52) U.S. Cl.
CPC ..... *G05G 1/487* (2013.01)

(58) Field of Classification Search
CPC ..... G05G 1/305; G05G 1/36; G05G 1/48; G05G 1/483; G05G 1/487; A61G 2203/14
See application file for complete search history.

(56) References Cited

U.S. PATENT DOCUMENTS 1,276,189 A * 8/1918 Dietz ..... G05G 1/30 74/513
2,481,966 A * 9/1949 Zivi ..... B60W 30/18 74/481
4,324,309 A * 4/1982 Ginley ..... B60W 30/18 180/316
4,424,723 A * 1/1984 Gockel ..... B60W 30/18 403/100
4,476,954 A * 10/1984 Johnson ..... B60W 30/18 123/352
4,788,879 A * 12/1988 Ulrich ..... B60W 30/18 180/320
5,012,689 A * 5/1991 Smith ..... B60W 30/18 200/317
5,025,905 A * 6/1991 Lenz ..... B60W 30/18 477/209
5,121,651 A * 6/1992 Bristow ..... B60W 30/18 403/122
5,129,492 A * 7/1992 Lenz ..... B60T 7/08 477/27
5,259,821 A * 11/1993 Bryant ..... F16H 7/14 403/108
5,542,312 A * 8/1996 Peters ..... B60W 30/18 180/333

(Continued)

*Primary Examiner* — Adam D Rogers
(74) *Attorney, Agent, or Firm* — Sanchelima & Associates, P.A.; Christian Sanchelima; Jesus Sanchelima

(57) ABSTRACT

The present invention is a device convertible for operating a brake and acceleration pedals of a vehicle by hands for a disabled driver and by legs for a physically fit driver. Device includes brake and acceleration frames, brake and acceleration foldable rods, brake and acceleration extending levers. Brake and acceleration frames are fixedly connected to the respective brake and acceleration pedals and are defined with the respective brake and acceleration cavities. Brake and acceleration foldable rods are defined with respective brake and acceleration pivotal ends. Brake and acceleration extending levers are selectively connected and disconnected at distal end of respective brake and acceleration foldable rods. When disabled driver drive, brake and acceleration extending levers are connected to respective brake and acceleration foldable rods. When physically fit driver drive, brake and acceleration extending levers are disconnected from respective brake and acceleration foldable rods that rest in respective brake and acceleration cavities.

7 Claims, 4 Drawing Sheets

(56) References Cited

U.S. PATENT DOCUMENTS

| | | | | | |
|---|---|---|---|---|---|
| 5,709,131 | A * | 1/1998 | Gummery | B60W 30/18 | 477/209 |
| 5,765,416 | A * | 6/1998 | Cote | B60R 25/005 | 292/339 |
| 5,813,944 | A | 9/1998 | Grindle | | |
| 6,131,712 | A * | 10/2000 | Rhodenizer | B60T 17/223 | 188/3 H |
| 6,435,055 | B1 * | 8/2002 | Sato | B60T 7/02 | 74/481 |
| 7,040,447 | B1 * | 5/2006 | Mawhinney | G05G 1/487 | 180/315 |
| 2014/0157935 | A1 * | 6/2014 | Ayon | B60K 26/02 | 74/483 R |

* cited by examiner

DEVICE CONVERTIBLE FOR OPERATING BRAKE AND ACCELERATION PEDALS OF A VEHICLE BY HANDS AND LEGS

BACKGROUND OF THE INVENTION

1. Field of the Invention

The present disclosure relates to a device for facilitating operation of a brake pedal and an acceleration pedal of a vehicle. More particularly, the present disclosure relates to a device that is convertible to be used by a disabled driver's hands and a physically fit driver's legs to operate a brake pedal and an acceleration pedal of a vehicle.

2. Description of the Related Art

Brake pedals and acceleration pedals of vehicles are required to be controlled by driver's feet and hence persons with leg disability find difficult to drive vehicles. Hand-operated devises are fixedly fitted in vehicles that facilitate disabled persons to drive vehicles. However, such vehicles, fixedly fitted with hand-operated devices, are for use of only disabled persons.

Several designs for hand-operated devices for operating brakes and acceleration pedals of vehicles have been designed in the past. None of them, however, includes a device that is convertible to be used by hands of a disabled person and legs of a physically fit person for operating brake and acceleration pedals of a vehicle.

Applicant believes that a related reference corresponds to US patent application 20140157935 filed by Efrain Ayon and Martha Rivera for an accel and brake. The Efrain and Martha reference discloses a device having a manually controlled operating system for permitting a handicapped person to brake and accelerate an automobile with hand operated controls. However, as the device is fixedly connected to brake and acceleration cables, the automobile is limited to be used by handicapped persons.

Another related application is U.S. Pat. No. 5,813,944 filed by GEORGE GRINDLE for a hand-operated speed control apparatus for attachment to a motor vehicle. The George reference discloses a speed-control device for attachment to the floorboard of a motor vehicle which allows for the hand-operation of the acceleration and braking systems. However, the device is fixedly attached to the floorboard of the motor vehicle and hence renders operational inconvenience for a normal person and limits the usage to disable person.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide a device convertible to be interchangeably used by hands of a disabled person and legs of a physically fit person to operate brake and acceleration pedals of a vehicle.

It is an object of the present invention to provide a device that includes brake and acceleration frames mountable on respective brake and acceleration pedals that facilitates controlling of brake and acceleration pedals by resting brake and acceleration foldable rods within brake and acceleration frames and placing driver's feet thereon.

It is an object of the present invention to provide a device that includes brake and acceleration frames mountable on respective brake and acceleration pedals that facilitates controlling of brake and acceleration pedals by use of driver's hands through brake and acceleration extending levers connected to brake and acceleration foldable rods having pivotal connection with brake and acceleration frames.

It is an object of the present invention to provide a device that is quickly convertible for operation of brake pedal and acceleration pedal by hands and legs.

It is an object of the present invention to provide a device that provides ease for driving a vehicle by a disabled person, a driver with short height, a driver with long height and a driver having an average height by use of various attachments.

It is an object of the present invention to provide a device that is easy to fit in existing vehicles as well as new vehicles.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
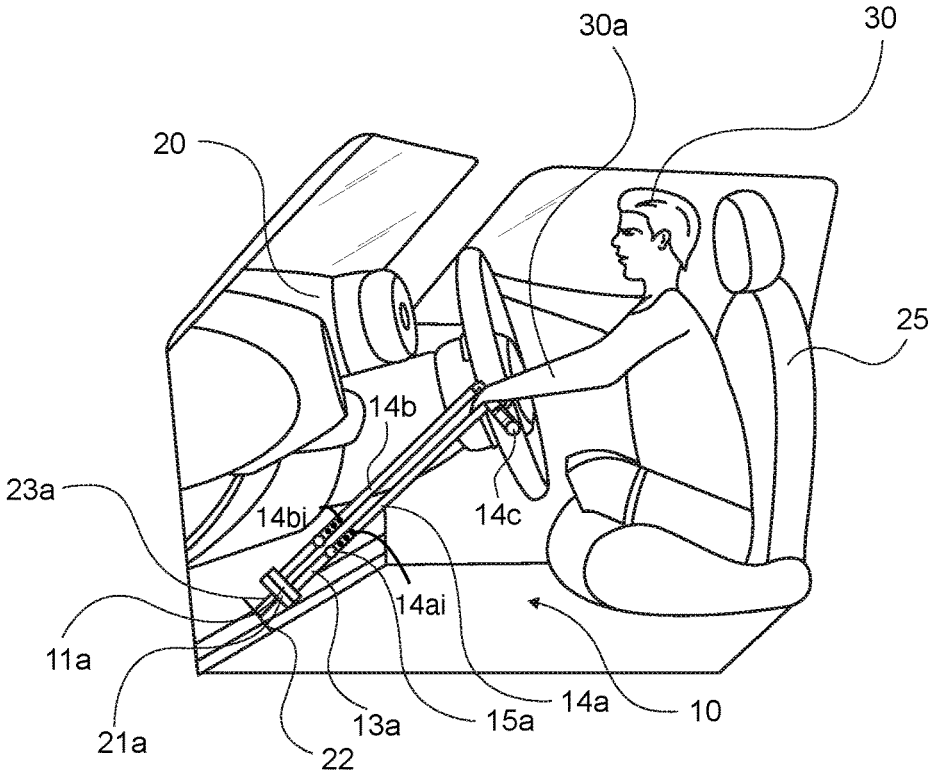
FIG. 1 represents a schematic representation of a device 10 in an operating configuration in which user 30 utilizes hand 30*a* to operate a brake pedal 21*a*.

Referring now to the drawings, FIGS. 1-10, where the present invention is generally referred to with numeral 10, it can be observed that a device for operating a brake pedal 21*a* and an acceleration pedal 21*b* of a vehicle that are mounted on a floorboard 22 below the dashboard 20 and connected by respective connecting rods 23*a* and 23*b*, in accordance with one embodiment, is provided that includes a brake frame

11*a*, a brake foldable rod 13*a*, a brake extending lever 14*a*, a brake connector 15*a*, an acceleration frame 11*b*, an acceleration foldable rod 13*b*, an acceleration extending lever 14*b* and an acceleration connector 15*b*.

Brake frame 11*a* is fixedly connected on brake pedal 21*a* of vehicle. In depicted embodiment, fasteners 11*aiii* are used to connect brake frame 11*a* with brake pedal 21*a* through holes 12*a* configured in brake frame 11*a*. Typically, pluralities of movable clips (not illustrated in Figures) are provided in brake frame 11*a* that are movable below brake pedal 21*a* to corners brake pedal 21*a* from each side. Movable clips also receive fasteners to clamp brake pedal 21*a* between brake frame 11*a* and movable clips. In another embodiment, brake frame 11*a* slides over brake pedal 21*a* to establish a fitment. Although the connection between brake frame 11*a* and brake pedal 21*a* is described by use of fasteners and slide fitment, however, other fitments are within the scope of the present disclosure that can connect brake frame 11*a* to brake pedal 21*a* and thereby restrict relative movement there between. Thus, installation of brake frame 11*a* on brake pedal 21*a* is easy and does not require any drilling. Brake frame 11*a* is defined with a brake cavity 11*ai*. Using brake frame 11*a* increases height of brake pedal 21*a* and hence driver with short height can easily position legs on brake pedal 21*a* and achieve ergonomic comfort while driving. In one embodiment, brake frame 11*a* is made of aluminum material having advantages of lightweight and economical. However, any other materials or combination of materials can be used instead of aluminum. Brake frame 11*a* is made of a universal design that can be easily fitted to break frames of different vehicles.

Brake foldable rod 13*a* is defined with a brake pivotal end 13*ai* and a distal end 13*aii*. Brake pivotal end 13*a* is fitted in brake cavity 11*ai* by use of a connecting rod 16*a* and fasteners 13*aiii* and facilitates brake foldable rod 13*a* to selectively achieve a resting configuration and an operating configuration. Distal end 13*aii* is selectively connected with brake extending lever 14*a* and an adjustable brake pedal 14*c*.

Brake extending lever 14*a* is selectively connected and disconnected with distal end 13*aii* of brake foldable rod 13*a*. In one embodiment, brake extending lever 14*a* is connected with a brake connector 15*a*. Brake connector 15*a* can be any one of a pin joint, an interlocking taper joint, a coupling device and the like. Brake extending lever 14*a* is optionally provided with a number of adjustment holes 14*ai* Brake foldable rod 13*a* is connected by a pin 14*aii* to any one of the desired adjustment hole 14*ai* to achieve a desired length, thus enabling length adjustment for users of different height. Brake connector 15*a* is such that the connection and disconnection of brake extending lever 14*a* and brake foldable rod 13*a* is easy. Brake foldable rod 13*a* is lifted from the resting configuration and brake extending lever 14*a* is connected by brake connector 15*a* to achieve the operating configuration. When brake connector 15*a* disconnects brake extending lever 14*a* and brake foldable rod 13*a*, brake foldable rod 13*a* rest in the resting configuration. In one embodiment, brake extending lever 14*a* and brake foldable rod 13*a* are disconnected by use of a push button (not shown).

Adjustable brake pedal 14*c* is selectively connected and disconnected with distal end 13*aii* of brake foldable rod 13*a* by inserting and removing a pin 14*ci*. Adjustable brake pedal 14*c* has a lever 14*d* provided with a plurality of holes 14*e* that can be selectively and variably connected to brake foldable rod 13*a* for achieving desired height. Thus, adjustable brake pedal 14*c* is adjusted to achieve different height for users of different height.

Acceleration frame 11*b* is fixedly connected on acceleration pedal 21*b* of vehicle. In depicted embodiment, fasteners 11*biii* are used to connect acceleration frame 11*b* with acceleration pedal 21*b* through holes 12*b* configured in brake frame 11*b*. Typically, a plurality of movable clips (not illustrated in Figures) are provided in acceleration frame 11*b* that are movable below acceleration pedal 21*b* to corners acceleration pedal 21*b* from each side. Movable clips also receive fasteners to clamp acceleration pedal 21*b* between acceleration frame 11*b* and movable clips. In another embodiment, acceleration frame 11*b* slides over acceleration pedal 21*b* to establish a fitment. Although the connection between acceleration frame 11*b* and acceleration pedal 21*b* is described by use of fasteners 11*biii* and slide fitment, however, other fitments are within the scope of the present disclosure that can connect acceleration frame 11*b* to acceleration pedal 21*b* and thereby restrict relative movement therebetween. Thus, installation of acceleration frame 11*b* on acceleration pedal 21*b* is easy and does not require any drilling. Acceleration frame 11*b* is defined with an acceleration cavity 11*bi*. Using acceleration frame 11*b* increases height of acceleration pedal 21*b* and hence driver with short height can easily position legs on acceleration pedal 21*b* and achieve ergonomic comfort while driving. In one embodiment, acceleration frame 11*b* is made of aluminum material having advantages of light weight and economical. However, any other materials or combination of materials can be used instead of aluminum. Acceleration frame 11*b* is made of a universal design that can be easily fitted to acceleration frames of different vehicles.

Acceleration foldable rod 13*b* is defined with an acceleration pivotal end 13*bi* and a distal end 13*bii*. Acceleration pivotal end 13*b* is fitted in acceleration cavity 11*bi* by use of a connecting rod 16*b* and fasteners 13*biii* and facilitates acceleration foldable rod 13*a* to selectively achieve a resting configuration and an operating configuration. Distal end 13*bii* is selectively connected with acceleration extending lever 14*b* and an adjustable acceleration pedal (not illustrated in Figures) similar to adjustable brake pedal 14*c*.

Acceleration extending lever 14*b* is selectively connected and disconnected with distal end 13*bii* of acceleration foldable rod 13*b*. In one embodiment, acceleration extending lever 14*a* is connected with an acceleration connector 15*b*. Acceleration connector 15*b* can be any one of a pin joint, an interlocking taper joint, a coupling device and the like. Acceleration extending lever 14*b* is optionally provided with a number of adjustment holes a number of adjustment holes 14*bi* similar to adjustment holes 14*ai* of brake extending lever 14*a*. Acceleration foldable rod 13*b* is connected by a pin (not illustrated in Figures) similar to pin 14*aii* to any one of the desired adjustment hole to achieve a desired length, thus enabling length adjustment for users of variable height. Acceleration connector 15*b* is such that the connection and disconnection of acceleration extending lever 14*b* and acceleration foldable rod 13*b* are easy. Acceleration foldable rod 13*b* is lifted from the resting configuration and acceleration extending lever 14*b* is connected by acceleration connector 15*b* to achieve the operating configuration. When acceleration connector 15*b* disconnects acceleration extending lever 14*b* and acceleration foldable rod 13*b*, acceleration foldable rod 13*b* rest in the resting configuration. In one embodiment, acceleration extending lever 14*b* and acceleration foldable rod 13*b* are disconnected by use of a push button (not shown).

Adjustable acceleration pedal is selectively connected and disconnected with distal end 13*bii* of acceleration foldable rod 13*b* by inserting and removing a pin (not illustrated in Figures) similar to pin 14*ci*. Adjustable acceleration pedal has a lever similar to lever 14*d* provided with a plurality of holes similar to plurality of holes 14*e* that can be selectively and variably connected for achieving desired height. Thus, adjustable acceleration pedal is adjusted to achieve different height for users of different height.

In one embodiment, brake extending lever 14*a* and acceleration extending lever 14*b* are connected to a hand-operated handle 14*f* for facilitating ease of operating brake extending lever 14*a* and acceleration extending lever 14*b* by user's hand.

Figure 2:
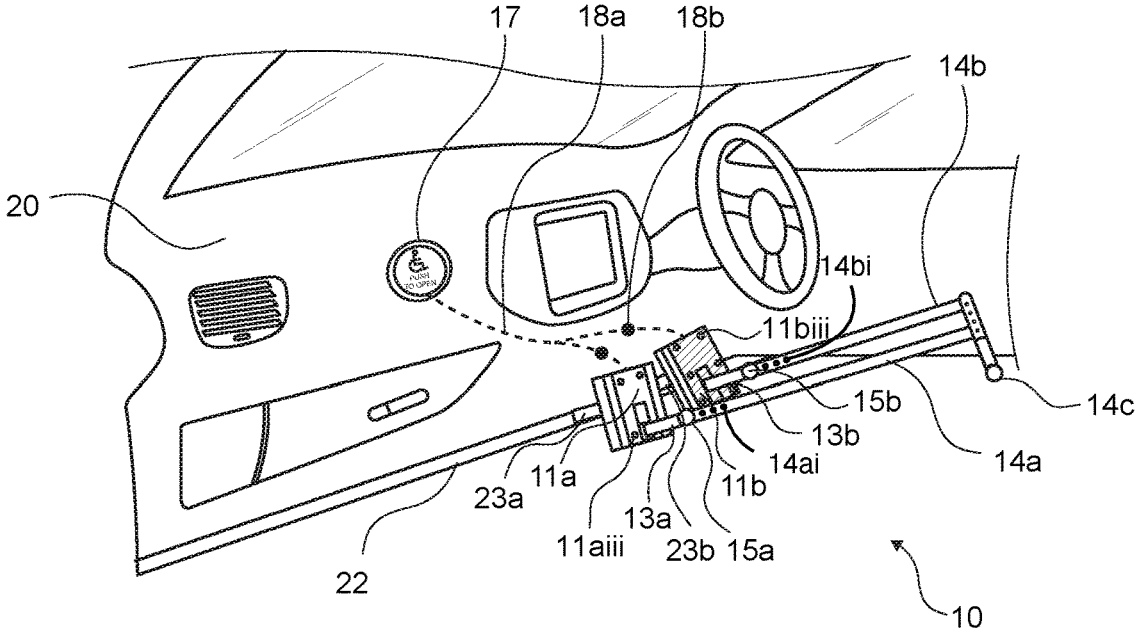
FIG. 2 shows a schematic enlarged view of a dashboard area of a vehicle fitted with device 10 providing hand operation of a brake pedal 21*a* and an acceleration pedal 21*b*.
Figure 3:
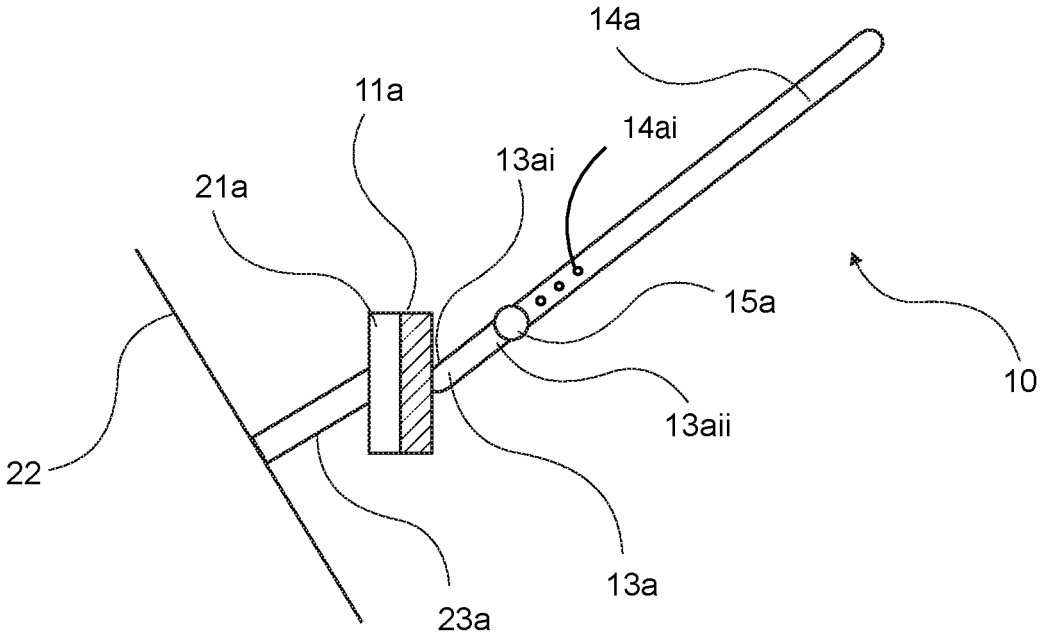
FIG. 3 demonstrates a schematic representation of a brake frame 11*a*, a brake foldable rod 13*a*, a brake extending lever 14*a* and a brake connector 15*a* of device 10.
Figure 4:
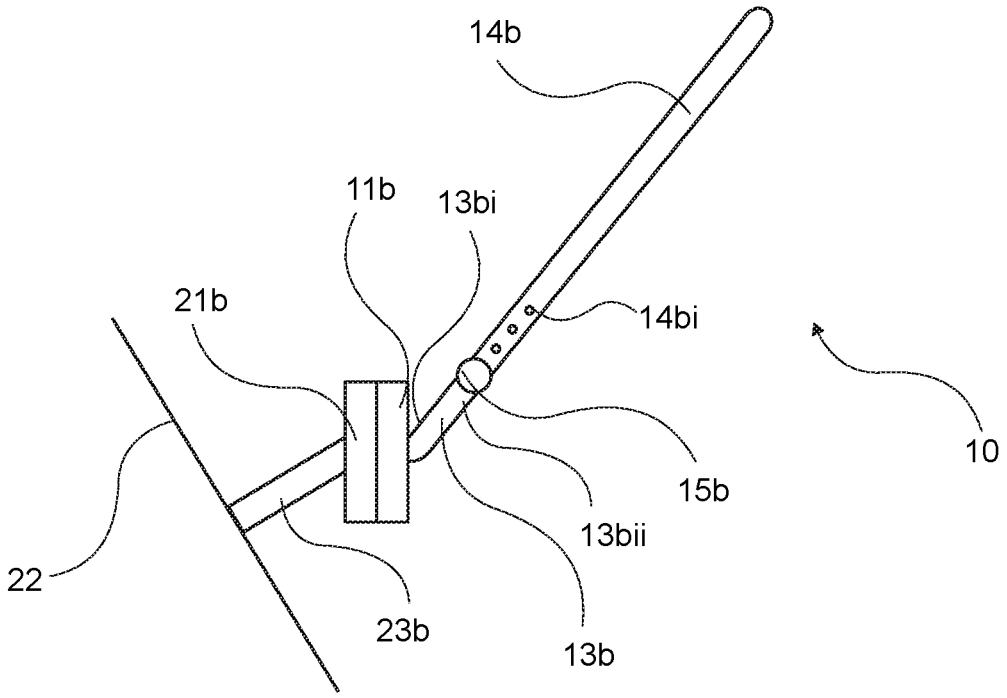
FIG. 4 demonstrates a schematic representation of an acceleration frame 11*b*, an acceleration foldable rod 13*b*, an acceleration extending lever 14*b* and an acceleration connector 15*a* of device 10.
Figure 5:
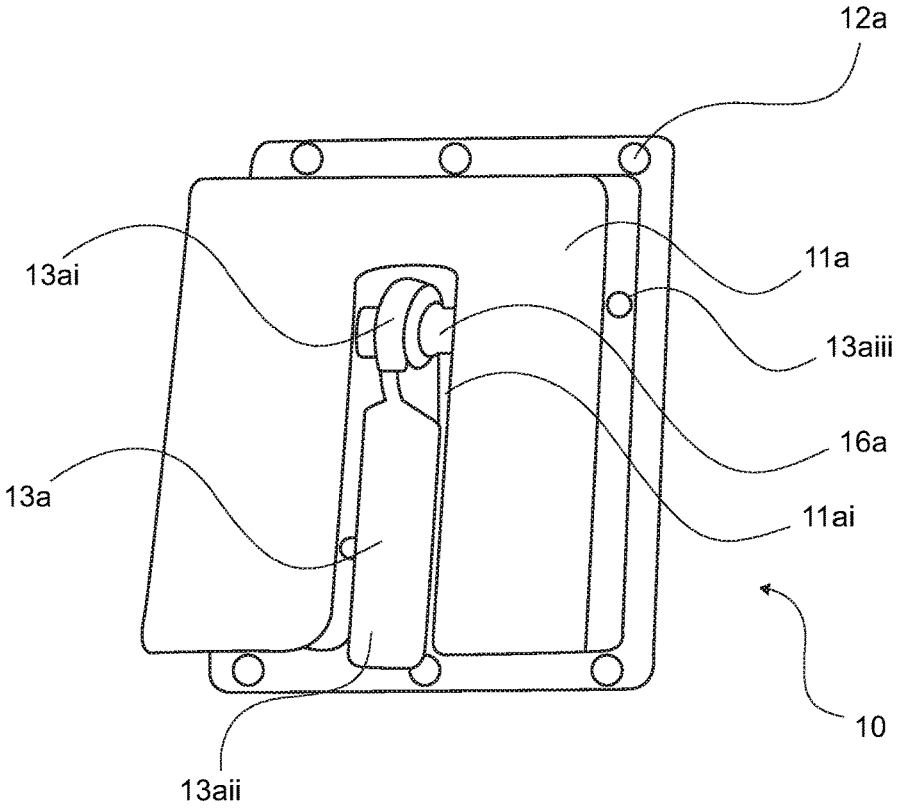
FIG. 5 demonstrates a perspective view of brake frame 11*a* with brake foldable rod 13*a* in resting configuration.
Figure 6:
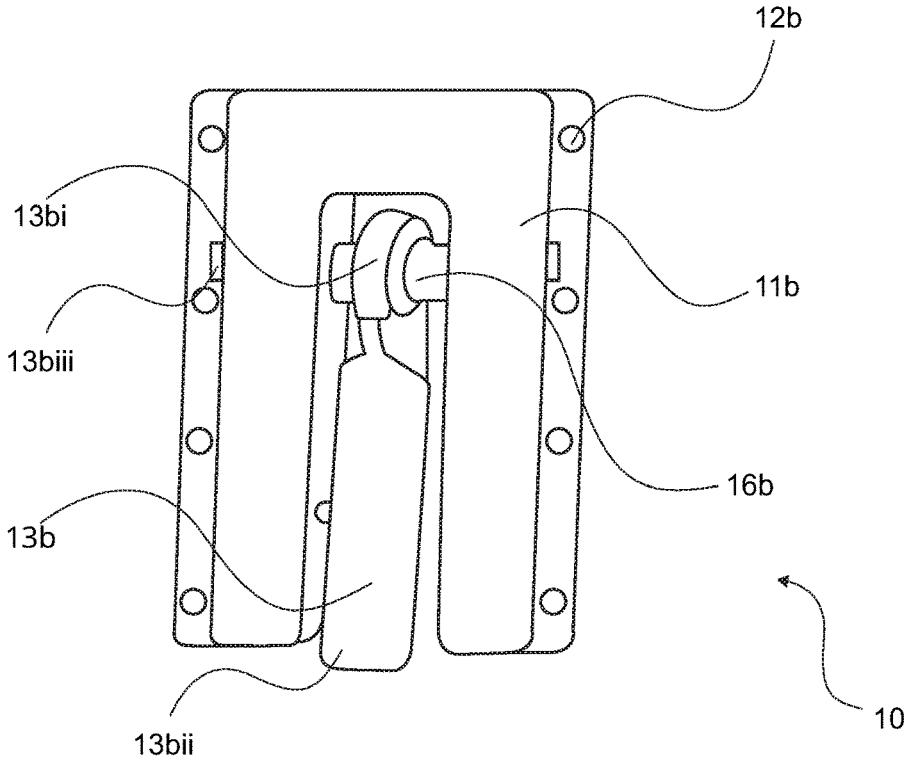
FIG. 6 demonstrates a perspective view of acceleration frame 11*b* with acceleration foldable rod 13*b* in resting configuration.
Figure 7:
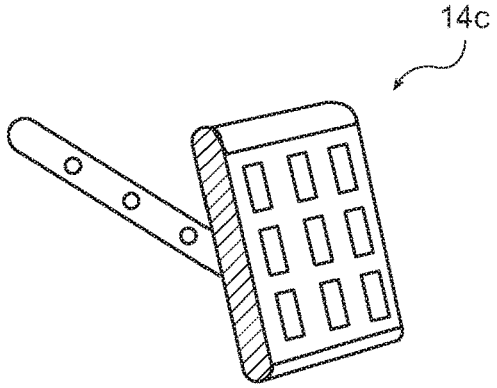
FIG. 7 demonstrates a perspective view of an adjustable brake pedal 14*c*.
Figure 8:
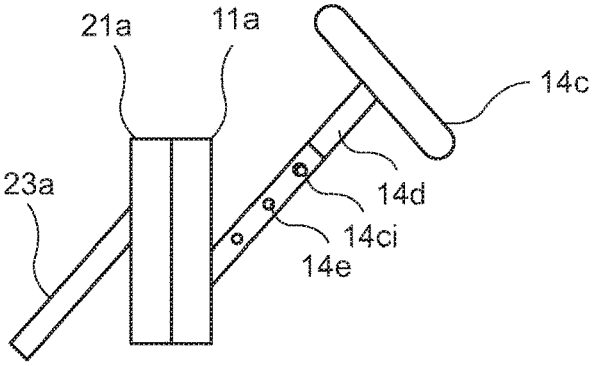
FIG. 8 demonstrates an assembled view of adjustable brake pedal 14*c* assembled with brake extending lever 14*a*.
Figure 9:
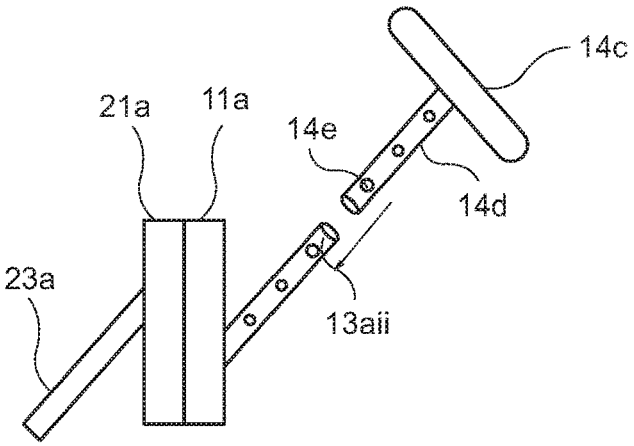
FIG. 9 demonstrates an exploded view of adjustable brake pedal 14*c* assembled to brake extending lever 14*a* depicting holes 14*e* provided for adjustment.

In an additional embodiment, brake foldable rod 13*a* and acceleration foldable rod 13*b* are manipulable from resting configuration and operating configuration by operating an operating button 17 (which also can be a knob or a switch). Operating button 17 can be positioned anywhere in interior of vehicle and in vicinity of driver seat 25 such that a person sitting on driver seat 25 can easily operated operating button 17. As illustrated in FIG. 2, operating button 17 is provided on dashboard 20 or alternatively it can be provided near the hand brake (not illustrated in Figures) or near the ignition key hole (not illustrated in Figures). When operating button 17 is switched to ON-state, then brake foldable rod 13*a* and acceleration foldable rod 13*b* are automatically lifted from resting configuration to operating configuration and when switched to OFF-state, brake foldable rod 13*a* and acceleration foldable rod 13*b* are automatically rested from operating configuration to resting configuration. Automatic lifting and resting of brake foldable rod 13*a* and acceleration foldable rod 13*b* is performed by a linkage mechanism 18*a*, 18*b* which can be mechanical, hydraulic or pneumatic. Linkage mechanism and operating button 17 can be fitted as an accessory of vehicle during purchase or can be retro-fitted in existing vehicles. Linkage mechanism and operating button 17 provides ease to handicap drivers 30 to connect and disconnect brake extending lever 14*a* and acceleration extending lever 14*b* with respective brake foldable rod 13*a* and acceleration foldable rod 13*b* by automatic lifting and resting brake foldable rod 13*a* and acceleration foldable rod 13*b* by mere operation of operating button 17.

During operation, when a disabled driver 30 wishes to drive the vehicle, brake acceleration extending lever 14*a* and acceleration extending lever 14*b* are connected to the respective brake foldable rod 13*a* and acceleration foldable rod 13*b* to achieve respective operating configuration. Disable driver 30 sitting on driver seat 25 operates the brake pedal 21*a* and the acceleration pedal 21*b* by manipulating brake acceleration extending lever 14*a* and acceleration extending lever 14*b* by use of hands 30*a*. When a physically fit driver wishes to drive the same vehicle, brake acceleration extending lever 14*a* and acceleration extending lever 14*b* are disconnected from the respective brake foldable rod 13*a* and acceleration foldable rod 13*b* and brake foldable rod 13*a* and acceleration foldable rod 13*b* are folded to achieve the resting configuration. Physically fit driver operates the brake pedal 21*a* and the acceleration pedal 21*b* by manipulating brake frame 11*a* and acceleration frame 11*b* by use of legs.

Thus, device 10 is easily and quickly convertible to operate brake pedal 21*a* and acceleration pedal 21*b*.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A device for operating a brake pedal and an acceleration pedal of a vehicle, said device comprising:

a brake frame fixedly connected to the brake pedal and defined with a brake cavity;

a brake foldable rod defined with a brake pivotal end fitted in the brake cavity and pivotal between a resting configuration and an operating configuration;

a brake extending lever selectively connected and disconnected at a distal end of said brake foldable rod;

an acceleration frame fixedly connected to the acceleration pedal and defined with an acceleration cavity;

an acceleration foldable rod defined with an acceleration pivotal end fitted in the acceleration cavity and pivotal between a resting configuration and an operating configuration;

an acceleration extending lever selectively connected and disconnected at a distal end of said acceleration foldable rod;

a linkage mechanism operated by an operating button to automatically manipulate said brake foldable rod and said acceleration foldable rod between the resting configuration and the operating configuration.

2. The device as claimed in claim 1, wherein said brake frame is connected to said brake pedal by fasteners.

3. The device as claimed in claim 1, wherein said acceleration frame is connected to said acceleration pedal by fasteners.

4. The device as claimed in claim 1, wherein said brake extending lever and said brake foldable rod are coupled by a brake connector.

5. The device as claimed in claim 1, wherein said acceleration extending lever and said acceleration foldable rod are coupled by an acceleration connector.

6. The device as claimed in claim 1, wherein said acceleration pedal and said brake pedal are selectively and adjustably connected to the respective acceleration foldable rod and brake foldable rod.

7. The device as claimed in claim 1, wherein said brake extending lever comprises a plurality of adjustment holes for adjusting the position of the brake extending lever relative to the brake foldable rod, and wherein said acceleration extending lever comprises a plurality of adjustment holes for adjusting the position of the acceleration extending lever relative to the acceleration foldable rod.

* * * * *